United States Patent [19]

Dubach

[11] Patent Number: 4,964,537

[45] Date of Patent: Oct. 23, 1990

[54] PLASTIC CAP ASSEMBLY HAVING A CENTRAL SEALING PIN

[75] Inventor: Werner F. Dubach, Maur, Switzerland

[73] Assignee: Alfatechnic AG, Switzerland

[21] Appl. No.: 206,589

[22] Filed: Jun. 14, 1988

[30] Foreign Application Priority Data

Jun. 16, 1987 [CH] Switzerland ..... 2285/87

[51] Int. Cl.[5] ..... B67D 5/00

[52] U.S. Cl. ..... 222/83; 222/153; 222/520; 222/549

[58] Field of Search ..... 222/519, 520, 549, 153, 222/541, 80, 83.5, 522, 523, 531, 532, 521, 83; 215/313, 314, 225, 252, 257; 220/267, 277

[56] References Cited

U.S. PATENT DOCUMENTS

| | | | |
|---|---|---|---|
| 2,806,640 | 9/1957 | Wroblewski | 222/549 X |
| 3,010,619 | 10/1957 | Gronemeyer | 222/521 |
| 3,263,851 | 8/1966 | Grimsley | 222/521 |
| 3,578,223 | 5/1971 | Armour | 222/521 |
| 4,065,037 | 12/1977 | Haller | 222/521 X |
| 4,383,623 | 5/1983 | Page, III | 222/521 |
| 4,408,700 | 10/1983 | Fillmore et al. | 222/153 |
| 4,527,702 | 7/1985 | Heath, Jr. | 215/225 |
| 4,570,825 | 2/1986 | Stull | 222/541 X |
| 4,691,836 | 9/1987 | Wassilieff | 222/525 X |

FOREIGN PATENT DOCUMENTS

| | | | |
|---|---|---|---|
| 2589829 | 11/1985 | France | 222/521 |
| 0214095 | 8/1985 | Switzerland | 222/541 |
| 0217630 | 9/1985 | United Kingdom | 215/225 |

*Primary Examiner*—Joseph J. Rolla
*Assistant Examiner*—Boris Milef
*Attorney, Agent, or Firm*—Thomas W. Speckman; Douglas H. Pauley

[57] ABSTRACT

A plastic cap assembly has a base cap that can be installed on the neck of a container. Within the base cap there is a pour spout that serves as a sealing pin, can be moved axially upwards and downwards, and is closed off at the top. On the base cap there is a screw cap that can be turned. The screw cap has a central opening in which the pour spout that serves as the sealing pin engages when in the closed position. The pour spout has an outside thread that engages with an inside thread beneath the central opening in the screw cap. The advantges of this cap assembly lie in its good sealing characteristics and in the fact that, provided with a suitable penetrator, it can be used on containers sealed with a membrane or a foil.

7 Claims, 2 Drawing Sheets

FIG. 1
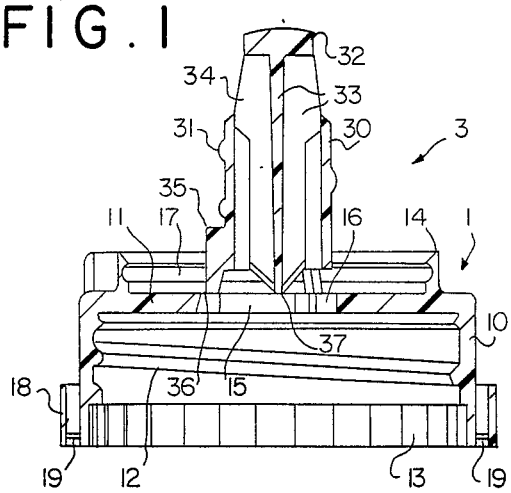
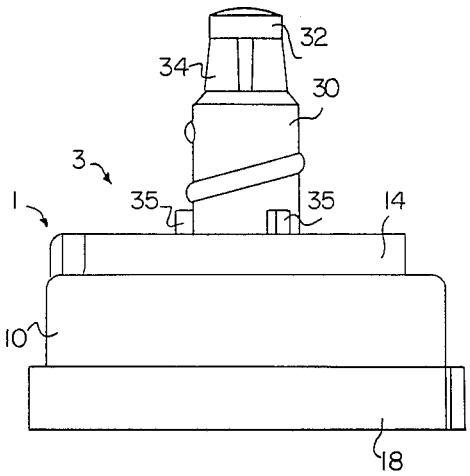
FIG. 2
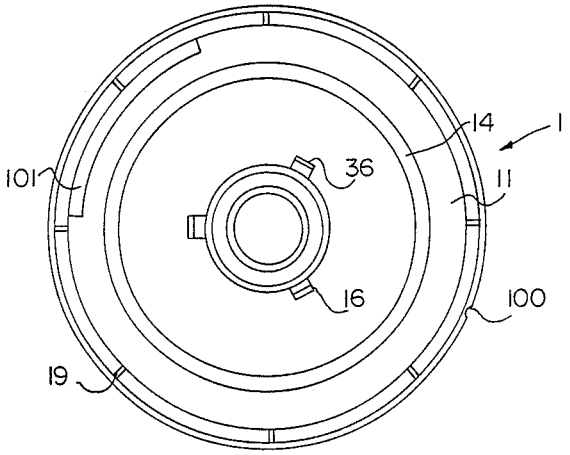
FIG. 3
FIG. 5
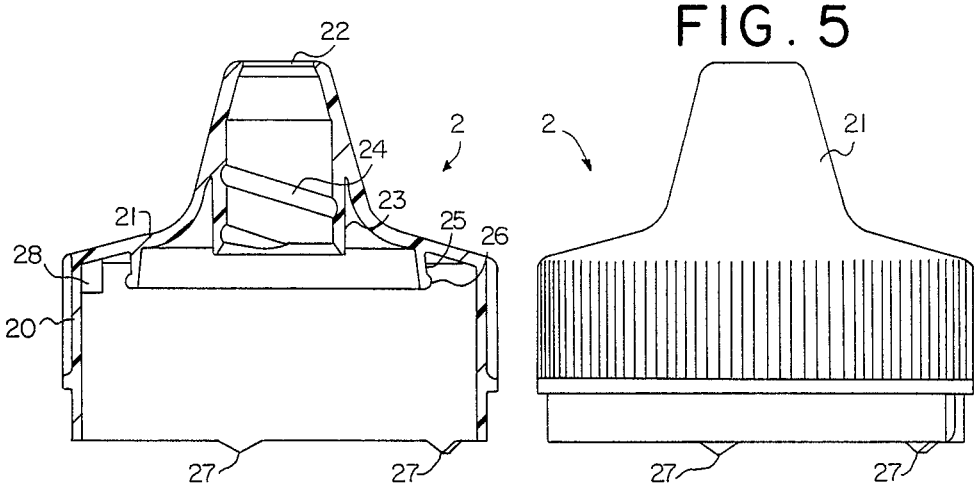
FIG. 4

FIG. 6
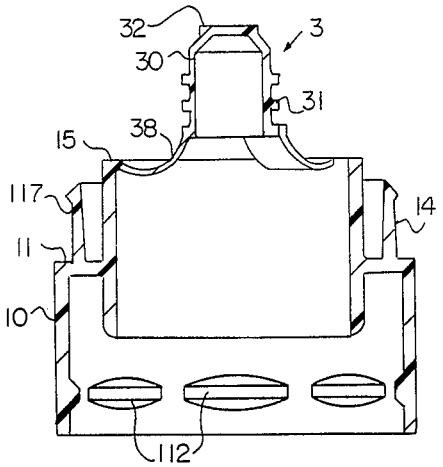
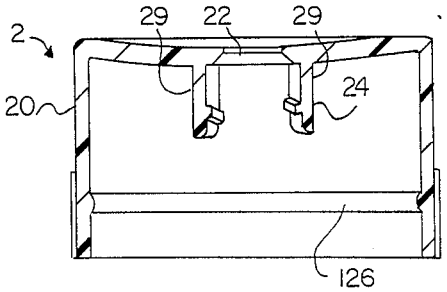
FIG. 7
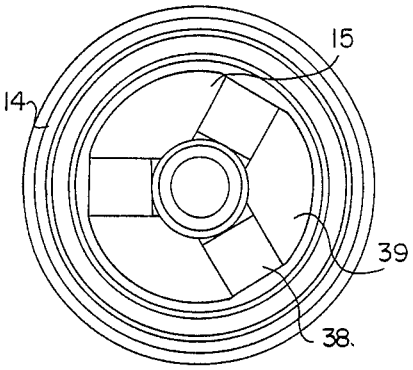
FIG. 8
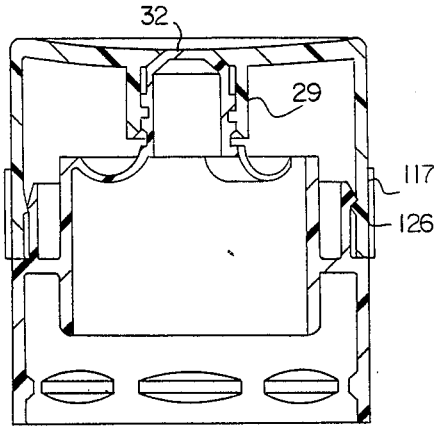
FIG. 9
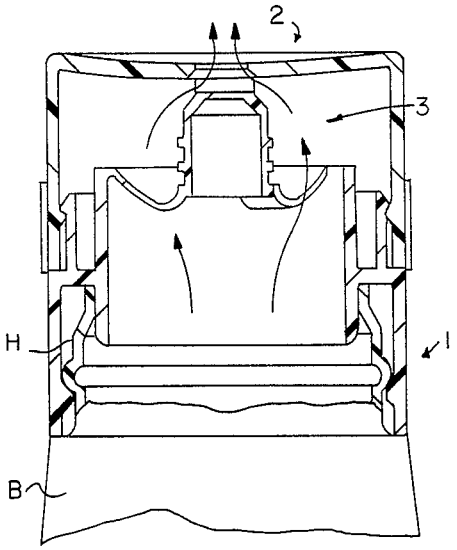
FIG. 10

PLASTIC CAP ASSEMBLY HAVING A CENTRAL SEALING PIN

BACKGROUND OF THE INVENTION

The present invention relates to a plastic cap system with a base cap that can be installed on the neck of a container, with an outlet and a pour spout that is connected with this and is closed at one end, this serving as a sealing pin, and with a screw cap that is rotably connected with the base cap and having a central opening, into which, when the cap system is in the closed state, the upper closed end of the pour spout protrudes so as to form a seal. Such cap assemblies have been commercially available for many years, and have been used as caps for plastic containers, in particular as used for liquid soap and cosmetics. In this area of application, such cap assemblies have exhibited only a few disadvantages. Above all, the most significant problem is their poor sealing capability. The above cited cap assemblies as in the state of the art operate with a base cap that is fixed as the cap assembly is opened and closed, and a spout or pin that is rigidly connected to this, and a screw cap that can be moved vertically up and down in an axial direction, relative to the base cap. The seal between the base cap and the screw cap is effected, on the one hand, between the central spout on the base cap and the edge of the central opening in the screw cap when the cap assembly is in the closed state and, on the other hand, directly between the outer annular wall of the base cap or the container neck and the vertical annular wall of the screw cap. At the second cited location, the seal is effected mostly through the inside thread of the screw cap and the outside thread of the base cap or the container neck. In the open position of the cap assembly, in which the screw cap has been displaced upwards relative to the container neck, the threads engage each other only partially and the seal is thus imperfect. This is the result of the fact that the total space beneath the screw cap fills with the contents of the container and, when the cap assembly is closed, this has to be forced back into the container.

Plastic cap assemblies of this kind have not been used for foodstuffs, for these impose far greater demands for seal quality. Such containers are mostly sealed with aluminum foil. However, because cap assemblies with a sealing pin must be secured against twisting off, cap assemblies of this kind could not be used on sealed containers.

SUMMARY OF THE INVENTION

Thus, it is the task of the present invention to create a plastic cap assembly with a base cap that can be installed on the neck of a container, with an outlet and a pour spout that is connected thereto and closed at one end, this pour spout serving as a sealing pin, and with a screw cap that is rotably connected with base cap and has a central opening within which, when the cap assembly is in the closed position, the upper, closed end of the pour spout protrudes so as to form a seal, which has improved sealing characteristics. It is a further task of the present invention to so configure the cap assembly that, if so required, it is suitable for use on sealed containers.

This task has been solved by a plastic cap assembly as set forth immediately above being characterized in that the pour spout is so supported or held, respectively, within the base cap as to be movable upwards and downwards in an axial direction and secured against twisting in a radial direction; and in that the pour spout has an outside thread which meshes with an inside thread in at least one section of wall that is arranged beneath the screw cap and surrounds the spout.

Such a cap assembly is suitable for containers having necks that are sealed with a foil, provided that a spike-like penetrator is provided at the lower end of the spout that can be moved axially upwards and downwards.

It is also an advantage if the base cap is fitted with a separable safety sealing band that prevents twisting of the screw cap by virtue of a shape-locking fit. In the first instance, this provides a guarantee that caps of this kind have never been removed. Further advantageous configurations may include ribs that extend radially outwards are arranged on the pour spout, the ribs fitting together with shape-locking recesses in the outlet of the base cap so that the pour spout is supported with the base cap so as to be able to slide and so as to be secured against twisting; a screw cap has a shorter annular wall, which is displaced inwards towards its outer peripheral wall, and which fits positively with an annular wall arranged on the base cap; and wherein one annular wall has an annular groove whereas the other annular wall has an annular bead, so that when in the use position the annular bead is within the annular groove; the base cap has a stop bar that is oriented axially upwards and interacts with a lug that is oriented radially inwards on the underside of the screw cap, thereby determining the angle of twist of the screw cap relative to the base cap; the wall section that has the inside thread and encloses the pour spout is a sleeve that is connected rigidly to the screw cap and wherein the pour spout tapers conically to the end in the upper area beneath closed end and has lateral outlet openings; the base cap and the pour spout are connected to each other so as to form one piece by bridge-like predetermined break point between radial ribs and edges of form locked recesses in the outlet of the base cap; the lower end of the spout can be moved axially upwards and downwards and has a spike-like penetrator; the spout comprises a pipe-like section in which at least two diametrical continuous walls extend, on which at the upper end there is a cover that closes off the spout and which below converge to form a central tip that forms the penetrator; the spout is arranged through a plurality of flexible wall sections with the base cap in one piece so as to be secured against twisting and be movable axially in the area of the outlet; the spout is in the form of a pipe that is closed at one end and wherein beneath the central opening in the screw cap there are at least two wall sections that enclose the spout; the base cap has an inside thread for attachment to the neck of the container and at the other end has a serrated, saw-toothed edge that prevents the the cap from being screwed off the neck of the container; the base cap has a separable safety sealing band which prevents the screw cap from being twisted off by means of shape-locking means; and a separable safety sealing cap is arranged on the base cap through a plurality of bridge pieces and wherein on the lower edge of the screw cap there is at least one projection that protrudes relative to the lower edge and which protrudes between two adjacent bridge pieces when the cap assembly is safety-sealed.

BRIEF DESCRIPTION OF THE DRAWING

The present invention will be described in greater detail below on the basis of two preferred embodiments of the invention that are shown in the drawings showing the following:

FIG. 1: The base cap of a first embodiment of the plastic cap assembly according the present invention, in the position as produced in cross section;

FIG. 2: The base cap as in FIG. 1, in a side view;

FIG. 3: The base cap as in FIG. 1, in plan view;

FIG. 4: The screw cap shown in cross section for the base cap as shown in FIGS. 1 to 3;

FIG. 5: A side view of the screw cap as shown in FIG. 4;

FIG. 6: The base cap of a second embodiment in cross section;

FIG. 7: The screw cap for the base cap as shown in FIG. 6 in cross section;

FIG. 8: The base cap shown in FIG. 6 in plan view;

FIG. 9: The base cap of FIG. 6 and screw cap of FIG. 7 in closed position in cross section; and FIG. 10: The cap assembly of FIG. 9 in open position, in cross section.

DESCRIPTION OF PREFERRED EMBODIMENTS

Reference is first made to the composite drawing in FIG. 10 in order to explain the most important parts of the cap. The plastic cap comprises three main parts, of which a base cap 1 and a screw cap 2 are always separate parts, whereas a pour spout 3 that is functionally connected with the central opening in the screw cap 2 is either a separate element when in the use position, as in the embodiment shown in FIGS. 1 to 5, or else is a part that is connected rigidly to the base cap, as is the case in the embodiment shown in FIGS. 6 to 10. In each case, the base cap 1 is secured to the neck H of the container B, there being a number of known possibilities for achieving this.

FIGS. 1 to 3 illustrate a particular case insofar as the base cap 1 and the pour spout 3 are shown to be in one piece, in the form in which they are produced. When the cap is assembled, however, the connections are destroyed and the pour spout 3 is separated from the base cap 1. The base cap 1 has a vertical, annular casing wall 10 that is limited at the top by a top surface 11. In this embodiment, the lower part 10 has a thread 12 by means of which it is secured to the neck H of the container. The lower edge of the casing wall 10 is serrated or saw-toothed 13 in order to prevent its being unscrewed from the neck of the container. On the top surface 11 there is a vertical, enclosed annular wall 14, that is displaced inwards relative to the casing wall 10. This is concentric with the outlet 15 in the top surface 11. The shape of the outlet is round and it incorporates a plurality of recesses 16, the shape and position of which correspond to the radially projecting ribs on the pour spout 3. The annular wall 14 has a circular, rounded annular groove 17 on the inside. As has already been discussed, the pour spout 3 is here shown in a position that corresponds to the production position. This pour spout 3 is essentially a section 30 of pipe or tube that has an outside thread 31. At the top, this section 30 of pipe is closed off by means of a cover 32. This cover 32 is supported by means of two walls 33 that pass diametrically through the pipe section 30 and which are perpendicular to each other. For this reason, between the upper edge of the pipe section 30 and the cover 32 there are four openings 34 that are defined by the two diametrical walls 33. At the lower end of the pipe section 30 of the pour spout 3 there are three ribs 35; these are spaced apart at regular intervals and directed radially outwards. The ribs 35 are connected to the top surface 11 of the base cap 1 by the predetermined break points 36 in the production position. When the cap assembly is assembled these predetermined break points are destroyed and the pour spout is separated from the base cap and moved to a lower position. A further feature of this pour spout is the fact that the two walls that pass diametrically through the pipe section 30 converge at the bottom to a common, central point 37. The cover 32 is of a slightly smaller diameter than the inside diameter of the pipe section 30. Accordingly, the two walls 33 converge conically to the cover 32. The screw cap 2 that is part of the assembly including base cap 1, as in FIGS. 1 to 3, is shown in FIGS. 4 and 5. The inside diameter of the vertical outer casing wall 20 of the screw cap 2 corresponds to the outside diameter of the casing wall 10 of the base cap 1, so that the screw cap 2 can be fitted like a union nut over the base cap 1 and the spout 3 that is supported therein. The surface 21 of the cap is also formed to match the shape of the pouring spout 3. At the top of the surface 21 there is a central opening 22. The diameter of the central opening 22 is exactly the same as that of the cover 32 of the pouring spout 3, so that the cover 32 fits precisely in the opening 22 so as to seal it.

A cylindrical sleeve 23 is formed on the inner side of the screw cap 2, beneath the central opening 22. The sleeve 23 has an inside thread 24 in which the outside thread 31 of the pouring spout 3 fits exactly. An annular wall 25 that extends concentrically around the sleeve 23 has an outside annular bead 26.

When the cap is assembled, the annular bead 26 lies in the annular groove 17 of the annular wall 14 on the base ca 1. This renders any relative movement between the base cap and the screw cap impossible in an axial direction, whereas a twisting of the two parts relative to each other is ensured. A brief description of the function of this embodiment of the cap assembly and the functional interaction of the various parts thereof follows. First, the assembly of the cap assembly will be explained. The screw cap 2 is slipped onto the base cap 1 as shown in FIGS. 1 to 3. The pour spout 3 enters the cylindrical sleeve 23. No the screw cap 2 is screwed down until the cylindrical sleeve lies on the radial ribs 35. At the same time, the annular bead 26 lies on the annular wall 14 on the base cap 1. Now the base cap 1 and the screw cap 2 are squeezed axially together until the break points 36 break and the annular bead 26 snaps into the groove 17 in the annular wall 14 of the base cap. Now the pour spout 3 and the base cap 1 are two separate parts and the base cap 1 and the screw cap 2 cannot be moved in an axial direction, although they ca twist relative to each other.

On assembly, the vertical casing wall 20 of the screw cap 2 slides over the vertical casing wall 10 of the base cap 1. When displaced axially, the lower end of the casing wall 20 slides behind the safety seal 18, which is connected by thin cross or bridge pieces to the casing wall lo of the base cap. In this position, the cap assembly is closed and sealed.

If the cap assembly is now to be opened for the first time, all that one has to do is to screw on the screw cap in the usual way. However, since the cap cannot be moved axially, the now loose pour spout 3 slides downwards until the cover 32 is beneath the central opening 22. At the same time, the small projections 27 separate the bridge pieces 19 on the lower edge of the casing wall 20 and the safety seal 18 that is open at the separation points 100 falls off. A stop bar 101 that is concentric with the annular wall 14 prevents the pour spout being screwed out of the sleeve 23, since it forms a stop on the inner side of the screw cap with a lug 28 that is directed inwards. In the open position the container contents can now flow through the pour spout and pass into the spout 3 through the side openings 34. From there, the container contents flow around the cover 32 and pass to the outside through the central opening 22 in the screw cap.

In the embodiment described the cap assembly can also be installed on a container, the neck of which is sealed with an aluminum foil. The first time the cap assembly is opened, the tip 37 that is formed by the two walls 33 passes through the aluminum foil. In contrast to the other cap assemblies, which must first be screwed on in order to break the foil seal, in this embodiment the end user cannot see the foil seal. This makes it possible to use a particularly inexpensive foil that can be allowed to oxidize.

The embodiment shown in FIGS. 6 to 10 is not suitable for installation on foil-sealed containers because here the outlet 15 is in the form of a section of pipe and the pour spout is secured rigidly on top of this pipe section through three flexible wall sections 38. Between these flexible wall sections 38 there are three unobstructed outlets 39. The remaining parts of the base cap 1 as seen in the second variation, that are identical or analogous, bear the same reference numbers. Here, too, the vertical casing wall 10 is fitted with a closing top surface 11 on which there is a concentric annular wall 14 about the container neck, the base cap is provided with a plurality of projections 112 that are arranged in a circle, so that the base cap 1 can be sprung over an annular bead on the container neck. Here, too, the screw cap 2 is pressed into place, although in this instance a shape-locking fit is achieved by means of an annular bead 117 that is part of the annular wall 14, instead of by means of an annular groove 17. Accordingly, the annular wall 25 on the screw cap 2 can be eliminated, because the annular bead 117 rests directly on the inner side of the casing wall 20 and snaps behind a corresponding annular bead 126, with which it forms a seal.

Here, the pour spout 3 is a cylinder 30 that is closed at one end and has an outside thread 31. Here, too, there is a cover 32, albeit a less pronounced one. Once again, this fits in the central opening 22 so as to seal it. Because the pour spout 3 is closed here, the contents of the container must be able to flow around its sides. This is achieved in that the pour spout 3 is enclosed by only two diametrically opposed clamp-like pairs of wall sections 29, which have threads 24. In the closed position shown in FIG. 9, the wall sections are in the plane of intersection and are thus visible, whereas in the open position, FIG. 10, they are out of the plane of intersection and for this reason cannot be seen.

I claim:

1. A plastic cap assembly comprising: a base cap (1) that can be installed on a neck (H) of a container, said base cap (1) having an outlet (15) and a pour spout (3) that is connected thereto and closed at one end, said pour spout serving as a sealing pin, a screw cap (2) rotatably connected with said base cap (1), said screw cap having a central opening (22), in a closed position, the upper closed end of said pour spout (3) protrudes within said central opening 922) forming a seal, said pour spout (3) being shaped as a pipe section (30) and being supported in said base cap (1) so as to be movable upwards and downwards in an axial direction and be secured against rotating, said pour spout (3) tapering conically toward an end in an upper area beneath the closed end (32) and having lateral outlet openings (34); and wherein said pour spout (3) has an outside thread (31) mateable with an inside thread (24) in at least one wall section (23, 29) rigidly connected to said screw cap (2) beneath said central opening 922) and which encloses said pour spout (3), a central spike-like penetrator (37) mounted within said pipe section (30) with diametrical walls (33), a lower end of said pipe section (30) having guide radial ribs (35) interacting with corresponding recesses (16) within said outlet (15), and said screw cap (2) having an annular cap wall (25) displaced toward an outer peripheral casing wall (10) of said base cap (1), one of an annular base wall (14) and said annular cap wall (25) having an annular groove (17) and the other of said annular base wall (14) and said annular cap wall (25) having an annular bead (26) whereby in a use position said annular bead (26) is mated within said annular groove (17).

2. A plastic cap assembly as defined in claim 1, wherein on said base cap (1) there is a stop bar (101) that is oriented axially upwards and interacts with a lug (28) that is oriented radially inwards on the underside of said screw cap (2), thereby determining an angle of rotation of said screw cap (2) relative to said base cap (1).

3. A plastic cap assembly as defined in claim 1, wherein prior to assembly, said base cap (1) is connected to said pour spout (3) forming one piece by break point (36 between radial ribs (35) and edges of form locked recesses (16) in said outlet (15) of said base cap (1).

4. A plastic cap assembly as defined in claim 1, wherein upon rotating said screw cap (2), said base cap (1) and said pour spout (3) are disconnected and a lower end of said pour spout (3) can be moved axially upwards and downwards.

5. A plastic cap assembly as defined in claim 1, wherein said base cap (1) has an inside thread (12) for attachment to said neck (H) of said container and at an opposite end has a serrated, saw-toothed edge (13) that prevents said base cap (1) from being screwed off said neck (H) of said container.

6. A plastic cap assembly as defined in claim 1, wherein on said base cap (1) there is a safety seal band (18) which prevents said screw cap (2) from being rotated off by shape-locking means.

7. A plastic cap assembly as defined in claim 1, wherein a safety seal (18) is attached to said base cap (1) through a plurality of bridge pieces (19); and wherein on a lower edge of said screw cap (2) there is at least one projection (27) that protrudes relative to said lower edge which protrudes between two adjacent said bridge pieces (19) when said cap assembly is safety-sealed and upon initially opening the plastic cap assembly said bridge pieces (10) break thereby allowing said safety seal (18) to be removed with respect to said base cap (1).

* * * * *